US011779169B2

(12) United States Patent
Penny

(10) Patent No.: US 11,779,169 B2
(45) Date of Patent: Oct. 10, 2023

(54) POTTY CHAIR COVER

(71) Applicant: Elease Penny, Baltimore, MD (US)

(72) Inventor: Elease Penny, Baltimore, MD (US)

( * ) Notice: Subject to any disclaimer, the term of this patent is extended or adjusted under 35 U.S.C. 154(b) by 30 days.

(21) Appl. No.: 17/819,814

(22) Filed: Aug. 15, 2022

(65) Prior Publication Data

US 2023/0036714 A1 Feb. 2, 2023

Related U.S. Application Data

(62) Division of application No. 17/033,780, filed on Sep. 26, 2020, now Pat. No. 11,445,868.

(51) Int. Cl.

| | |
|---|---|
| ***A47K 13/14*** | (2006.01) |
| ***A47K 11/04*** | (2006.01) |
| ***A47C 31/11*** | (2006.01) |

(52) U.S. Cl.

CPC ..... *A47K 13/14* (2013.01); *A47C 31/11* (2013.01); *A47K 11/04* (2013.01)

(58) Field of Classification Search

CPC ..... A47K 13/14; A47K 13/18; A47K 13/00; A47K 11/04; A47C 31/11

USPC ..... 4/483

See application file for complete search history.

(56) References Cited

U.S. PATENT DOCUMENTS

| | | | | |
|---|---|---|---|---|
| 5,121,938 | A * | 6/1992 | Gross | A61G 5/1043 297/DIG. 6 |
| 6,398,301 | B1 | 6/2002 | Illulian | |
| 7,637,567 | B2 | 12/2009 | Neustat et al. | |
| 8,038,211 | B2 | 10/2011 | Berk et al. | |
| 8,418,273 | B1 * | 4/2013 | Dorsey | A47K 13/14 4/245.3 |
| 9,999,305 | B1 | 6/2018 | Dryer et al. | |
| 11,445,868 | B2 * | 9/2022 | Penny | A47C 31/11 |
| 2012/0042443 | A1 * | 2/2012 | Aguila | A47K 13/06 4/245.6 |
| 2012/0146371 | A1 * | 6/2012 | Cotton | A47C 31/11 297/219.1 |
| 2018/0344109 | A1 * | 12/2018 | Lucas | A47K 13/005 |
| 2019/0254441 | A1 * | 8/2019 | Bell | A47C 31/11 |

OTHER PUBLICATIONS

"The Dignity Cover," https://cdn.shopify.com/s/files/1/0066/6662/files/Bedside_Commode_Slipcover_Brochure.pdf.

* cited by examiner

*Primary Examiner* — Huyen D Le
(74) *Attorney, Agent, or Firm* — J. Greg Tinch

(57) ABSTRACT

A potty chair cover adapted for a training potty system. The cover is configured to both provide a snug fit for the potty chair when not in use for training, while also adapted to be removed quickly and easily when a toddler is ready to toilet train.

8 Claims, 3 Drawing Sheets

POTTY CHAIR COVER

CROSS REFERENCE TO RELATED APPLICATIONS

This application is a divisional of U.S. Non-provisional application Ser. No. 17/033,780 filed on Sep. 26, 2020 and allowed on May 13, 2022. The above identified patent applications are herein incorporated by reference in their entirety to provide continuity of disclosure.

TECHNICAL FIELD

This disclosure is specifically related to accessories for toilet training devices.

BACKGROUND

A potty chair cover for a potty chair is disclosed herein. "Potty chair" as used herein refers to a device used to facilitate the toilet training process—the process of teaching a toddler to use a toilet.

"Inseam" as used herein refers to a seam that binds a length of fabric from the top of the potty chair to the bottom.

"Fabric fastener" as used herein refers to a mechanism for fastening fabric, like a button, hook, zipper, Velcro, etc.

"Splash guard" as used herein refers to a raised portion on the front of a potty chair seat. A splash guard may or may not be integrated into the potty chair seat.

In reference to the numbering of edges, edges are numbered in ascending order in the clockwise direction from the first edge in the 12:00 position. The next edge in order is the next adjacent edge. For example, for a square, the first edge faces the 12:00 position, the second edge faces the 3:00 position, etc.

BRIEF SUMMARY OF THE DISCLOSURE

Implementations of a potty chair cover are shown and described herein.

A potty chair cover comprising: a first panel, a second panel, a third panel, wherein the first panel joined to the second panel at a seam, the third panel joined to the first panel and the second panel at a seam to form a pocket, and wherein the pocket configured to fit a potty chair having a base and a backrest and adapted to resemble a standard toilet.

BRIEF DESCRIPTION OF THE SEVERAL VIEWS OF THE DRAWINGS

Implementations of a potty chair cover are illustrated in FIGS. 1-4.

DETAILED DESCRIPTION

FIGS. 1-4 show implementations of a potty chair cover. It should be understood that the scope of the disclosure should not be limited to the implementations shown and described herein.

Figure 1:
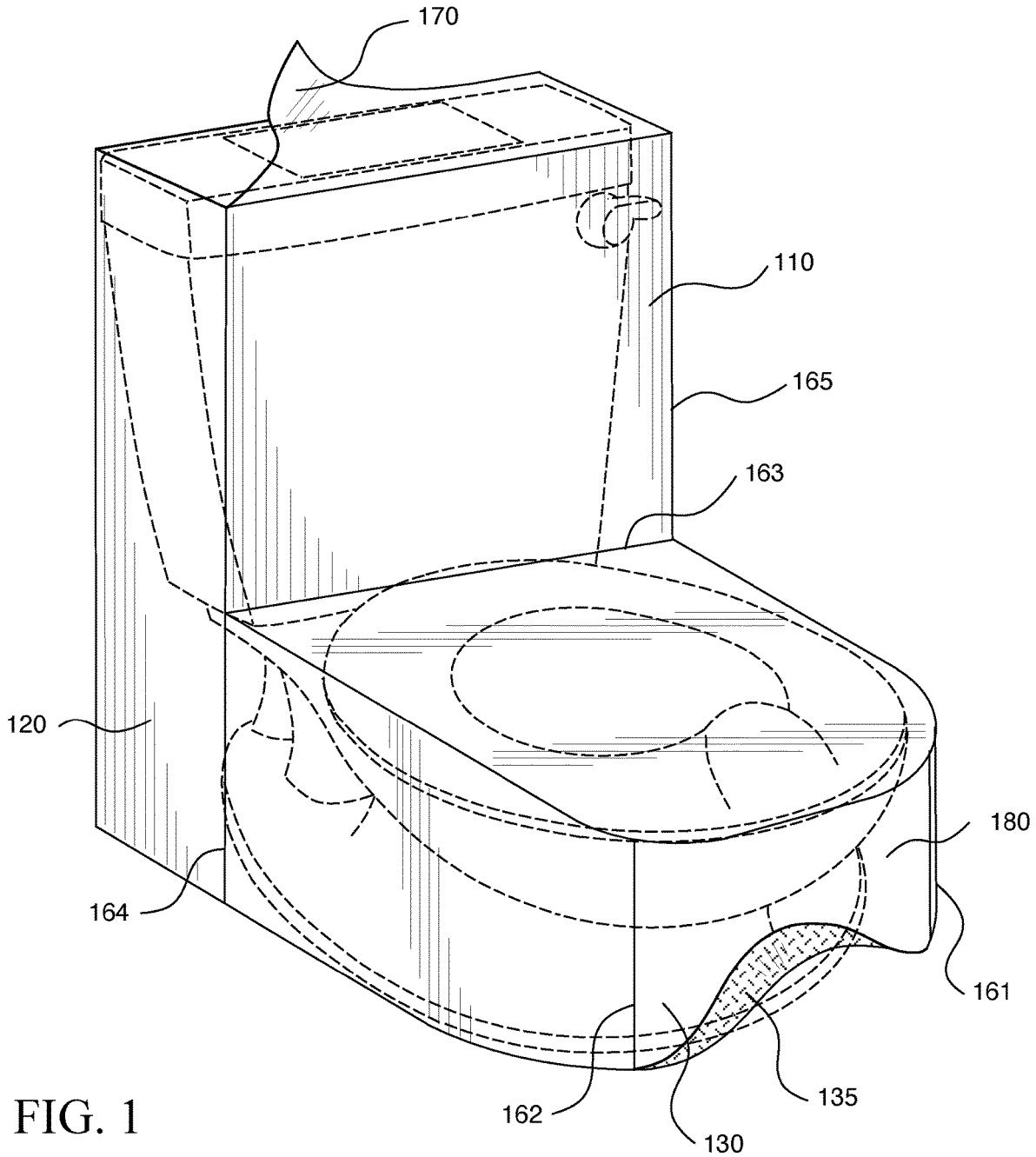
FIG. 1 is a perspective view of an implementation of a potty chair cover as it may be used with an exemplary potty chair.

FIG. 1 is a perspective view of an implementation of a potty chair cover as it may be used with an exemplary potty chair. An exemplary potty chair 180 as shown in FIG. 1, and denoted by broken lines, may comprise a base having a seat and a backrest. In implementations, the dimensions of an exemplary potty chair may be approximately 15 inches high, 11 inches wide and 15 inches deep.

In implementations, a potty chair cover may comprise: a first panel 400 having eight edges; a second panel 410 having four edges; a third panel 420 having four edges; wherein the third edge of the first panel 400 is joined at the fourth edge of the first panel 400; wherein the sixth edge of the first panel 400 is joined at the seventh edge of the first panel 400; wherein the third edge of the second panel 410 is joined at the first edge of the first panel 400; wherein the fourth edge of the third panel 420 is joined at the fourth edge of the second panel 410 and the first edge of the first panel 400; and wherein the second edge of the third panel 420 is joined at the second edge of the second panel 410 and the first edge of the first panel 400.

In implementations of a potty chair cover, each of a first panel 400, a second panel 410, and a third panel 420 may be fabric. In implementations of a potty chair cover, each of a first panel 400, a second panel 410, and a third panel 420 may be woven fabric. In implementations of a potty chair cover, each of a first panel 400, a second panel 1010, and a third panel 420 may be stretch fabric.

In implementations of a potty chair cover, the midpoint of a first edge of a first panel 400 may be joined at the midpoint of a third edge of a second panel 410 such that the first edge of first panel 400 is contiguous with the third edge of second panel 410 and the first edge of second panel 410 is also contiguous with the first edge of first panel 400. In implementations of a potty chair cover, a fourth edge of a third panel 420 may be bound to a fourth edge of a second panel 410 and a first edge of a first panel 400 by a first panel inseam 164. In implementations of a potty chair cover, a second edge of third panel 420 may be bound to a second edge of a second panel 410 and a first edge of a first panel 400 by a second panel inseam 165.

In implementations of a potty chair cover, each of a first panel 400, a second panel 410, and a third panel 420 may further comprise a top-side face and an under-side face. In implementations of a potty chair cover, a top-side face of each of a first panel 400, a second panel 410, and a third panel 420 may be printed in a first pattern 130. In implementations of a potty chair cover, a top-side face of each of a first panel 400, a second panel 410, and a third panel 420 may be printed in a first pattern and an under-side face of each of a first panel 400, a second panel 410, and a third panel 420 may be printed in a second pattern 135.

In implementations of a potty chair cover, a third edge of a first panel 400 may be bound to a fourth edge of first panel 400 by a first corner seam 161. In implementations of a potty chair cover, a sixth edge of a first panel 400 may be bound to a seventh edge of first panel 400 by a second corner seam 162. In implementations of a potty chair cover, a third edge of a second panel 410 may be joined at a first edge of first panel 400 and bound by a panel seam 163.

In implementations of a potty chair cover, the midpoint of a first edge of a first panel 400 may be joined at the midpoint of a third edge of a second panel 410 such that the first edge of first panel 400 is contiguous with the third edge of second panel 410 and the first edge of second panel 410 is also contiguous with the first edge of first panel 400. In implementations of a potty chair cover, a fourth edge of a third panel 420 may be bound to a fourth edge of a second panel 410 and a first edge of a first panel 400 by a first panel inseam 164. In implementations of a potty chair cover, a second edge of third panel 420 may be hound to a second edge of a second panel 410 and a first edge of a first panel 400 by a second panel inseam 165. In implementations of a potty chair cover, a first corner seam 161 and a second corner seam 162 may be approximately 6.5 inches in length. In implementations of a potty chair cover, a first panel inseam 164 and a second panel inseam 165 may be in the range approximately 11 inches to approximately 19 inches.

In implementations of a potty chair cover, the first edge of a second panel 410 is not joined at the first edge of a third panel 420 to form a flap opening 170. In implementations of a potty chair cover, the first edge of a second panel 410 may be joined at the first edge a third panel 420 by a fabric fastener to secure a flap opening 170. In implementations of a potty chair cover, a flap opening 170 may facilitate access to the backrest of an exemplary potty chair 180 without removing the potty chair cover.

Figure 2:
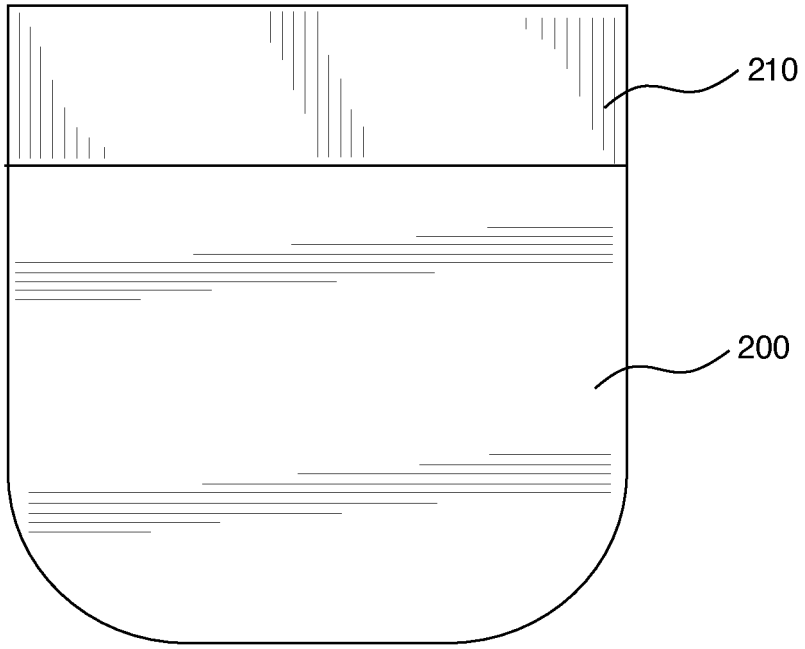
FIG. 2 is a top view of an implementation of a potty chair cover as it may be used with an exemplary potty chair.

FIG. 2 is a top view of an implementation of a potty chair cover as it may be used with an exemplary potty chair. FIG. 2 shows a first panel 200 and a second panel 210 according to an implementation of a potty chair cover. A third panel according to the implementation of a potty chair cover shown runs parallel to the view shown and is consequently obscured from this view.

Figure 3:
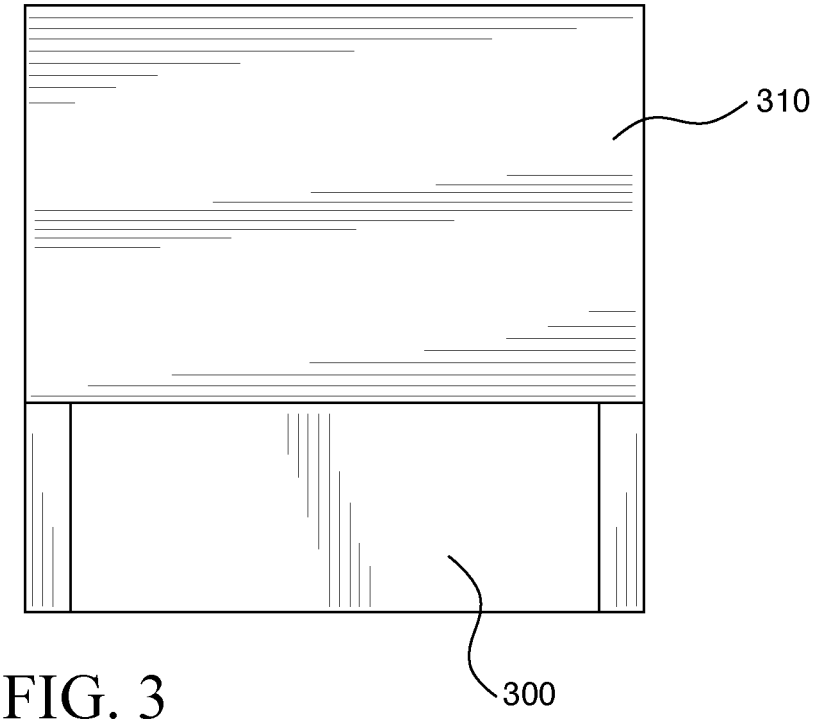
FIG. 3 is a front view of an implementation of a potty chair cover as it may be used with an exemplary potty chair.

FIG. 3 is a front view of an implementation of a potty chair cover as it may be used with an exemplary potty chair. FIG. 3 shows a first panel 300 and a second panel 310 according to an implementation of a potty chair cover. A third panel of the implementation of a potty chair cover shown is obscured from the front view.

Figure 4:
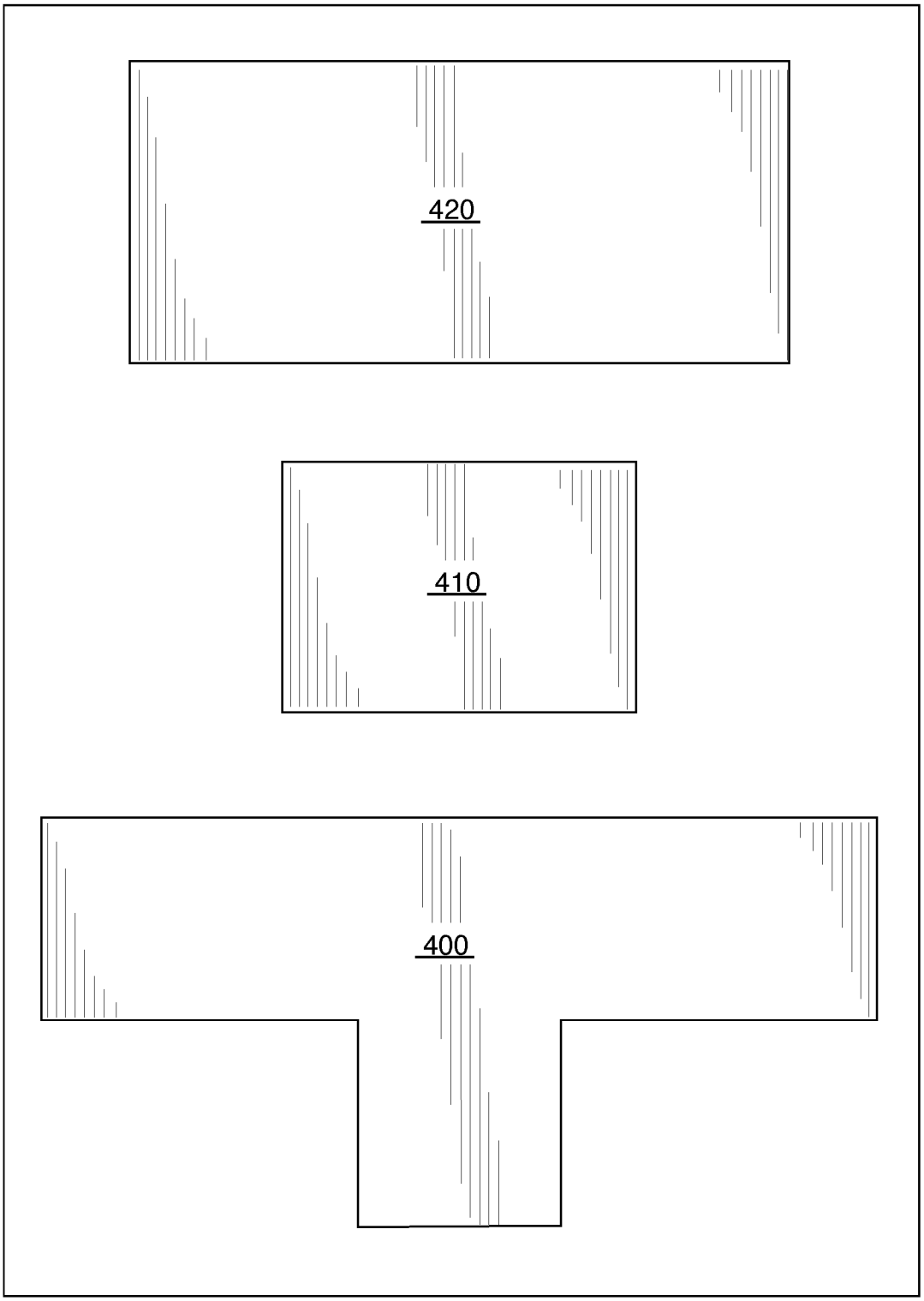
FIG. 4 shows component panels of an implementation of a potty chair cover.

FIG. 4 shows component panels of an implementation of a potty chair cover. In implementations of a potty chair cover, a first panel 400 may be generally T-shaped having eight edges. In implementations of a potty chair cover, the dimensions of a first panel 400, where edges may be numbered in ascending order in the clockwise direction from the first edge facing the 12:00 direction, may be as follows: a first edge may be approximately 24 inches in length; a second edge may be approximately 6.5 inches in length; a third edge may be approximately 11 inches in length; a fourth edge may be approximately 6.5 inches in length; a fifth edge may be approximately 11 inches in length, a sixth edge may be approximately 6.5 inches in length; a seventh edge may be approximately 6.5 inches in length, and an eighth edge may be approximately 11 inches in length.

In implementations, a potty chair cover may have a generally square second panel 410 having four edges. In implementations of a potty chair cover, where the edges of a second panel 410 may be numbered in ascending order in the clockwise direction from a first edge facing the 12:00 direction, may be oriented such that: a first edge and a third edge may be parallel; a second edge and a fourth edge may be parallel; and a first edge and a third edge may be perpendicular to the second and the fourth edges. In implementations of a potty chair cover, a first edge and a third edge of a second panel 410 may be approximately 10.5 inches in length. In implementations of a potty chair cover, a second edge and a fourth edges of a second panel 1310 may be approximately 13 inches in length.

In implementations, a potty chair cover may have a generally rectangular third panel 420 having four edges. In implementations of a potty chair cover where the edges of a third panel 420 may be numbered in ascending order in the clockwise direction from the first edge facing the 12:00 direction, may be oriented such that a first edge and a third edge of the third panel 420 may be parallel and perpendicular to a second edge and a fourth edge of the third panel 420. In implementations of a potty chair cover, a first edge and a third edge of a third panel 420 may be approximately 19 inches in long. In implementations of a potty chair cover, a second edge and a fourth edge of a third panel 420 may be approximately 16.5 inches long.

While specific implementations of the article have been described in detail, it will be appreciated by those skilled in the art that additional implementations could be developed in light of the overall teachings of the disclosure. Accordingly, the implementations disclosed are meant to be illustrative only and not limiting as to the scope of the article, which is to be given the full breadth of the appended claims and any equivalents thereof.

I claim:

1. A potty chair cover comprising:
a first panel,
a second panel,
a third panel,
wherein the first panel joined to the second panel at a seam,
the third panel joined to the first panel and the second panel at a seam to form a pocket, and
wherein the pocket configured to fit a potty chair having a base and a backrest and adapted to resemble a standard toilet.

2. The potty chair cover according to claim 1, wherein the first panel, the second panel, and the third panel are fabric.

3. A potty chair cover according to claim 1, further comprising:
the first panel having a top-side face and an under-side face; the second panel having a top-side face and an under-side face; and the third panel having a top-side face and an under-side face;
wherein the top-side face of each of the first panel, the second panel, and the third panel having a first pattern; and
wherein the under-side face of each of the first panel, the second panel, and the third panel having a second pattern.

4. A potty chair cover comprising:
a first panel having eight edges;
a second panel having four edges;
a third panel having four edges;
wherein a third edge of the first panel and a fourth edge of the first panel contiguous and joined at a seam;
wherein a sixth edge of the first panel and a seventh edge of the first panel contiguous and joined at a seam;
wherein a third edge of the second panel and a first edge of the first panel contiguous and joined at a seam;
wherein a fourth edge of the third panel, a fourth edge of the second panel, and the first edge of the first panel contiguous and joined at a seam;
wherein a second edge of the third panel, a second edge of the second panel, and the first edge of the first panel contiguous and joined at a seam;
wherein the third edge of the first panel and the fourth edge of the first panel contiguous and joined at a first corner seam;
wherein the sixth edge of the first panel and the seventh edge of the first panel contiguous and joined at a second corner seam;
wherein the first edge of the first panel and the third edge of the second panel contiguous and joined at a panel seam;

wherein the fourth edge of the third panel, the fourth edge of the second panel, and the first edge of the first panel contiguous and joined at a first panel inseam; and wherein the second edge of the third panel, a second edge of the second panel, and the first edge of the first panel contiguous and joined at a second panel inseam; and wherein the potty chair cover configured to create a pocket.

5. The potty chair cover according to claim 4, wherein the pocket is adapted to fit a potty chair having a base and a backrest.

6. The potty chair cover according to claim 4, further comprising:

the first panel, the second panel and the third panel having a top-side face and an under-side face;

wherein the top-side face of each of the first panel, the second panel, and the third panel having a first pattern; and wherein the under-side face of each of the first panel, the second panel, and the third panel having a second pattern.

7. The potty chair cover according to claim 4, further comprising:

the first edge of the second panel having at least a first fabric fastener; and wherein the first edge of the second panel is attached to the first edge of the third panel by the at least first fabric fastener.

8. The potty chair cover according to claim 4, wherein the first edge of the second panel and the first edge of the third panel contiguous and joined at a seam.

* * * * *